US006375562B1

(12) United States Patent
Hein

(10) Patent No.: US 6,375,562 B1
(45) Date of Patent: Apr. 23, 2002

(54) SLIDING DOOR

(75) Inventor: Christian Hein, Langenhagen (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/613,782

(22) Filed: Jul. 11, 2000

(30) Foreign Application Priority Data

Jul. 12, 1999 (DE) ..... 199 32 153

(51) Int. Cl.[7] ..... F24F 9/00
(52) U.S. Cl. ..... 454/188; 49/41; 49/31
(58) Field of Search ..... 454/188, 192, 454/195; 49/39, 40, 41, 42, 31

(56) References Cited

U.S. PATENT DOCUMENTS 3,049,984 A * 8/1962 Boysen ..... 454/188
4,341,165 A * 7/1982 Calandritti et al. ..... 109/8
5,987,817 A * 11/1999 Hein ..... 49/40

FOREIGN PATENT DOCUMENTS

DE 1030550 5/1958
DE 1291091 3/1969
DE 3806234 3/1992
DE 704188 3/1994
DE 4420167 11/1995
DE 19542714 5/1997
JP 259341 * 10/1988 ..... 454/192

OTHER PUBLICATIONS

Luftschleieranlagen Für Industrietore, Dipl. Ing. Herbert Murmann, Rielefeld, 690 TAB 10/88 pp. 753–756.

* cited by examiner

*Primary Examiner*—Harold Joyce
*Assistant Examiner*—Derek S. Boles
(74) *Attorney, Agent, or Firm*—Nils H. Ljungman & Associates

(57) ABSTRACT

The invention relates to a sliding door with two outer side-pieces extending from a building wall and surrounding a building entrance/exit, with at least one moving panel associated with the two side-pieces which closes or opens an entrance/exit as a result of its movement into a closed or open position, and with a ventilation system which, by means of at least one blower nozzle that is located so that it can pivot between the interior and exterior of the building, blows air into the building entrance/exit area, whereby the blower nozzle is coupled with a air speed indicator so that the pivoting angle of the blower nozzle can be adjusted as a function of the outside pressure on the outside of the building as measured by the air speed indicator.

8 Claims, 5 Drawing Sheets

SLIDING DOOR

DESCRIPTION

Figure 1:
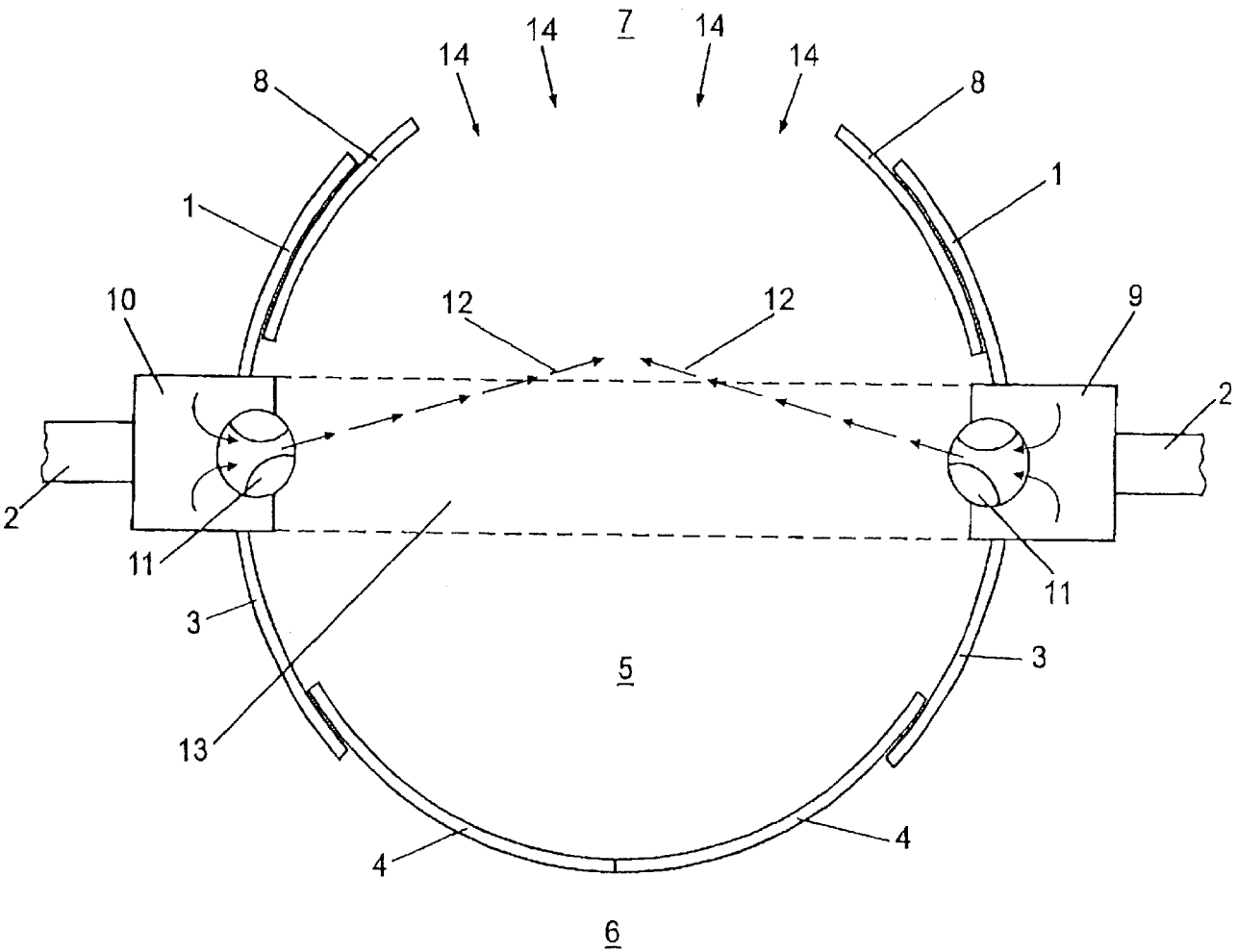

This invention relates to a sliding door as described in the introduction to claim 1.

DE 44 20 167 C1 describes a compact air curtain system to shield a building opening. In this case, the compact air curtain system has a fan that is installed in a housing as well as an air blower nozzle located on the downstream side of the fan. In this case, the air blower nozzle is installed so that it can be pivoted toward the outside of the building, and so that depending on the temperature difference between the interior of the building and the exterior of the building, an adequate shielding of the building opening can be achieved by an appropriate pivoting of the blower nozzle. The pivoting of the air blower nozzle as a function of the temperature is thereby achieved by coupling the air blower nozzle with a temperature sensor in the entrance area of the building opening. However, if wind gusts penetrate this air curtain system and blow into the building opening at temperatures which correspond to a temperature specified by a control unit for the air curtain system, there is no adjustment of the air blower nozzles and thus of the air curtain. Consequently, the wind gusts in the entrance area of the building can spread out and result in uncomfortable conditions.

The object of the invention is to realize a sliding door with a ventilation system, such that an adequate screening is also made possible even in the event of different outdoor wind pressures.

The object of the invention is accomplished on a sliding door of the prior art by the features disclosed in the characterizing portion of claim 1. The blower nozzle is thereby coupled with an air speed indicator or anemometer, so that the pivoting angle of the blower nozzle is set as a function of the air speed on the outside of the building measured by the air speed indicator.

The dependent claims disclose an additional configuration of the invention.

Because the blower nozzle is coupled with an air speed indicator, the blower nozzle can be set as a function of the wind load that acts on the entrance/exit, and can form an adequate air curtain. In other words, the air curtain withstands the outdoor wind load, and there are no gusts of air into the interior of the building.

It is also possible, as a result of the coupling of air speed indicator and blower nozzle by an appropriately located control unit, to adapt the blower air volume and thus the "strength" of the air curtain to the external wind load, and to prevent a penetration of the wind into the interior of the building.

The sliding door is preferably a curved sliding door and the side-pieces as well as the moving panel or panels are also realized in a curved shape. This realization of both the side-pieces and the moving panel in the form of a curved sliding door results in high stability even with high outdoor wind pressures.

To achieve an additional shielding of the interior of the building against penetrating wind gusts, the invention teaches, in an additional preferred embodiment, the provision of two additional inner side-pieces that run into the interior of the building and are adjacent to the external side-pieces, whereby there is at least one movable panel corresponding to the inner side-pieces. As a result of the combination of outer and inner side-pieces as well as outer and inner movable panels, an air lock is created which further minimizes the risk of the penetration of air into the interior of the building.

Because there are limits to the quantity of air that can be blown, and which are set by the sensitivity of the people entering and exiting the building, the degree of opening of the moving panel or panels is preferably set as a function of the wind speed measured by the air speed indicator. In other words, at very high wind speeds and thus very strong wind loads, the degree of opening of the moving panel or panels is reduced, so that less air can penetrate from outside into the air lock, as a result of which, to shield the penetrating quantity of air, a smaller quantity of air is discharged from the blower nozzle. To achieve a further optimization, there can be a reciprocal movement of the outer and inner moving panels, i.e. if the outer moving panel is opened, the inner moving panel is simultaneously closed and vice-versa.

The invention also teaches that it is advantageous to set the pivoting angle of the blower nozzle as a function of the degree of opening of the moving panel or panels. This measure further optimizes the shielding of the external wind pressure.

In one preferred embodiment of this invention, at least one blower nozzle is located on each of the two sides and on the ceiling of the building entry/exit area. This measure makes possible a closed air curtain over the full cross section of the entry/exit and thus an optimal screening against the external wind load.

To achieve a simple realization of the sliding door with the ventilation system claimed by the invention, the blower nozzles are each located in a ventilation duct which can be located, for example, in the vicinity of the connection between the sliding door and the building, and is therefore practically invisible.

Finally, instead of air, another gaseous medium can be discharged into the lock. The use of another medium can be beneficial in locks for clean rooms and similar applications.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

The invention is explained in greater detail below with reference to one exemplary embodiment which is illustrated in the accompanying drawings, in which:

FIG. 1: is an overhead view of a curved sliding door with a ventilation system.

Figure 2:
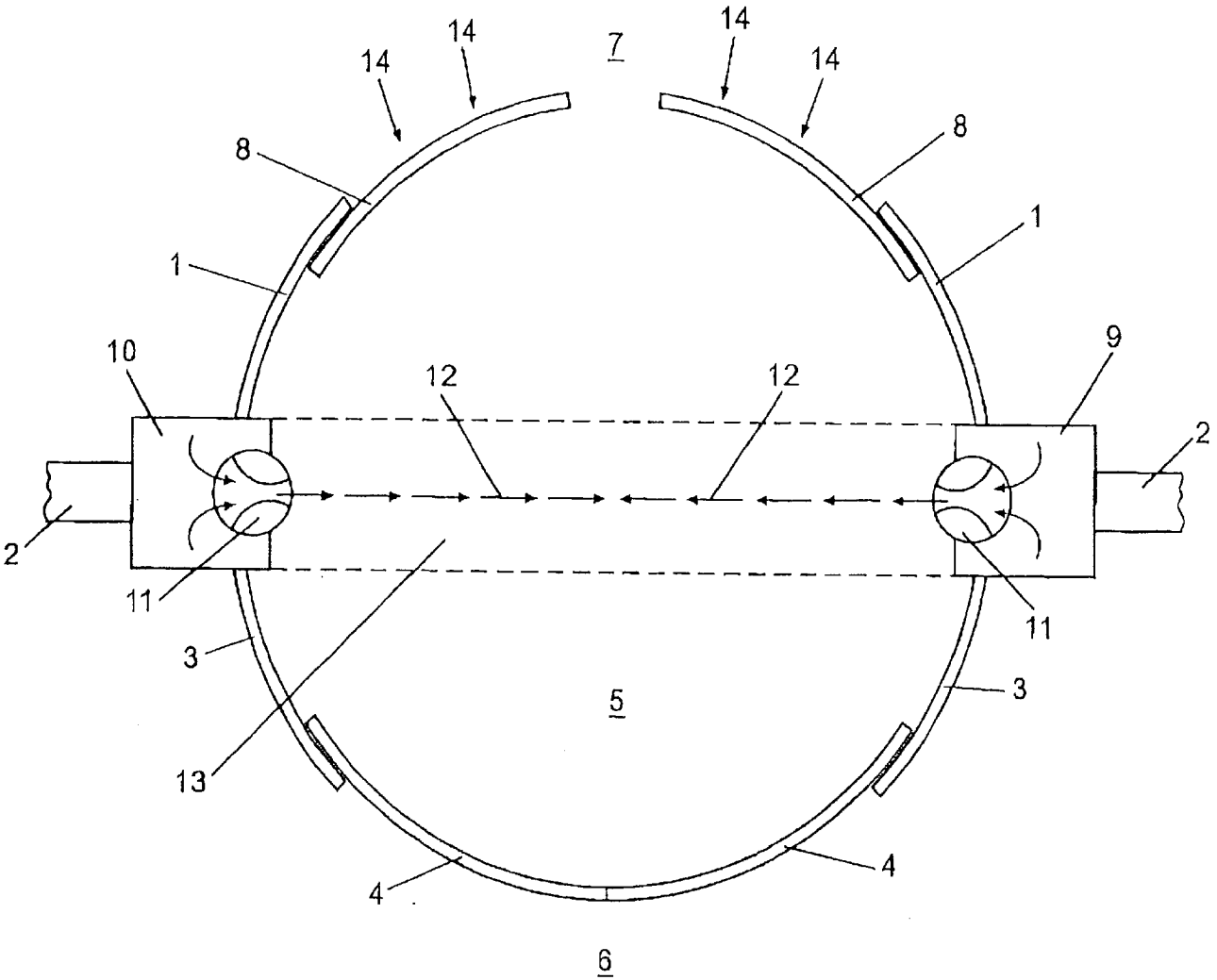

FIG. 2: is a view of the curved sliding door similar to FIG. 1, whereby the external moving panels are almost in the closed position.

Figure 3:
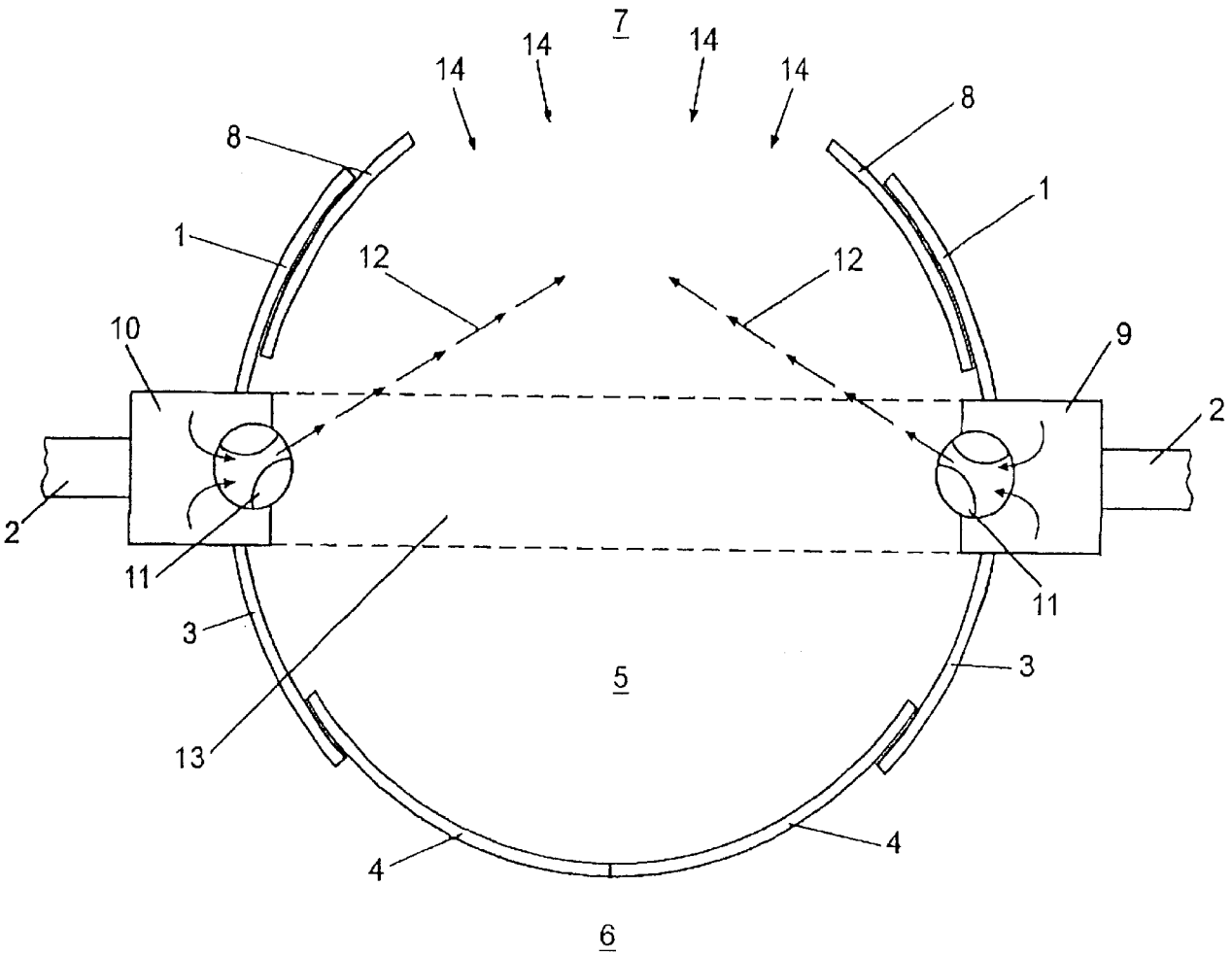

FIG. 3: is a view similar to FIG. 1, whereby the blower nozzles have a modified pivoting angle.

Figure 4:
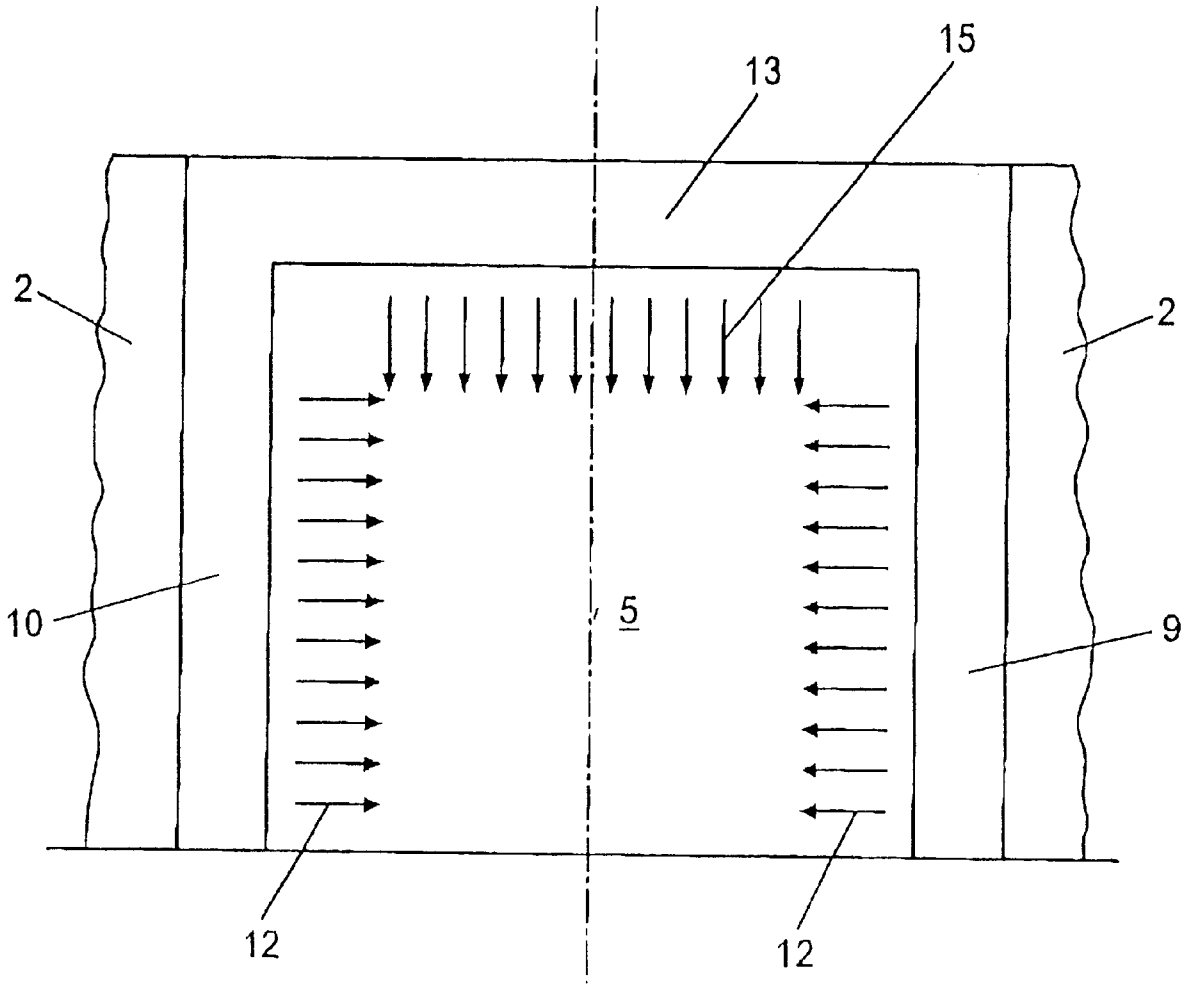

FIG. 4: is a simplified side view of the curved sliding door.

Figure 5:
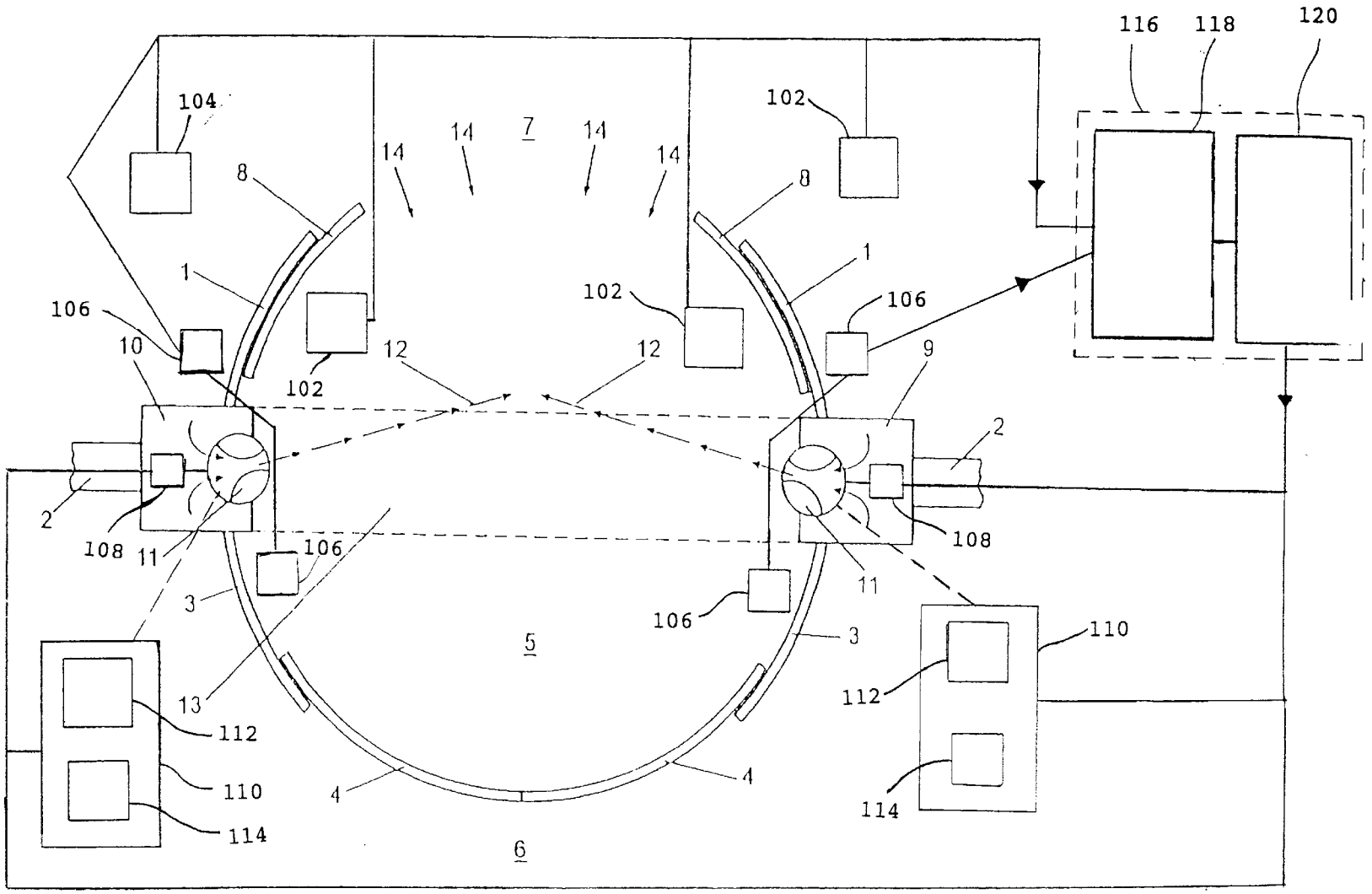

FIG. 5 shows a control system with sensor apparatus for the operation of a door system according to at least one possible embodiment of the present invention.

FIG. 1 is an overhead view of a curved sliding door as claimed by the invention. In this case, the curved sliding door consists of two curved outer side-pieces 1, each of which extends outward from ventilation ducts 9 and 10 respectively. The ventilation ducts 9, 10 are thereby located respectively on the long sides of the wall 2 of a building opening. In FIG. 1, the outside of the building is designated 7 and the inside of the building is designated 6.

With regard to the wall 2 as the line of symmetry 1, two inner side-pieces 3 are realized symmetrical to the outer side-pieces 1. Two curved outer and inner moving panels 8, 4 are guided so that they can move on the two outer side-pieces 1 and on the two inner side-pieces 3. In this case, the outer and the inner moving panels can assume either an open position, as with the moving panel 8 in FIG. 1, or a closed position, as with the moving panel 4 in FIG. 1. Naturally, the degree of opening of the moving panels 8, 4 can be varied continuously between the open and closed positions.

Moreover, located in each of the two vertical ventilation ducts 9, 10 are blower nozzles 11 for air. The blower nozzles 11 are thereby guided in the plane of the figure in FIG. 1 so that they can pivot from top to bottom, so that a flow direction 12 varies according to the pivoting action of the blower nozzles 11.

FIG. 1 also shows, in broken lines, a horizontal ventilation duct 13 which is equipped like the ventilation ducts 9, 10 with a blower nozzle (not shown). This nozzle 13 of the horizontal ventilation duct 13 is also installed so that it can pivot. Both the two blower nozzles 11 and also the blower nozzle (not shown) of a horizontal ventilation duct 13 can be pivoted, for example by means of a drive motor or hydraulically.

FIG. 1 shows the area of an indoor air lock 5 in which the air exchange takes place and which is defined by the inner side-pieces 3 and the inner moving panel 4. Although in FIG. 1, the inner side-pieces 4 are closed, they are naturally opened when a person passes through the curved sliding door.

Finally, the blower nozzles 11 are coupled with a air speed indicator (not shown), which is located approximately on the exterior wall of the building. The air speed indicator measures the wind pressure or the outdoor pressure. The pivoting angle of the blower nozzles 11 and of the blower nozzle (not shown) of the horizontal ventilation duct 13 are pivoted on the basis of this measurement, to achieve an adequate shielding of an outdoor pressure or the air current designated 14 that penetrates into the curved sliding door. In FIG. 1, the blower nozzles 11 are pivoted slightly toward the outside of the building, as a result of which, when the outer moving panels 8 are fully open and at normal outside pressure 14, an adequate shielding can be achieved for the interior 6.

In contrast, FIG. 2 shows the opening degree of the outer moving panel 8 as well as the orientation of the blower nozzles 11 with the airflow direction 12 and at a very high outdoor pressure. In this case, the outer moving panels 8 are almost completely closed and the blower nozzles 11 are pointing toward each other, as a result of which only a small volume of outdoor air penetrates into the interior of the curved sliding door, while the air current of the "air curtain" is realized intensively between the ventilation ducts 9, 10, 13.

In contrast, the exemplary embodiment of the curved sliding door claimed by the invention and illustrated in FIG. 3 shows the orientation of the blower nozzles 9, 10 at a low wind pressure or outdoor pressure 14. In this case, the outer moving panels 8 are fully opened. At the same time, the blower nozzles 11 assume their extreme outwardly pivoted position illustrated in FIG. 3. Naturally, the airflow direction 12 of the blower nozzles 11 is set accordingly.

Although it is not illustrated in FIGS. 1 to 3, in addition to the two parameters of pivoting angle and moving panel opening degree described above, there is a third parameter which can be set, namely the volume of air output from the blower nozzles 11 for an optimal adaptation of he air curtain to the outside pressure. Naturally, the discharge volume can also be adjusted as a function of the wind pressure measured by the air speed indicator. The processing of the values measured by the air speed indicator as well as the corresponding actuation of the blower nozzles 11 and of the outer moving panel 8 is done by a convention closed-loop or open-loop control circuit.

Finally, the side view in FIG. 4 shows schematically the airflow directions 12, 15, starting from the two vertical ventilation ducts 9, 10, and from the horizontal ventilation duct 13. As shown in FIG. 4, a closed air curtain over the full cross section of the entrance/exit area of a building is achieved as a result of the location of the blower nozzles 11 and the resulting airflow directions.

In an additional configuration of the invention, it is also possible to set the blower nozzle 11 only once after the sliding door has been stalled. The setting of the blower nozzle 11 is thereby determined on the basis of local conditions and the size (opening width) of the sliding door. In such a case, the quantity of air that is discharged through the blower nozzle 11 is adapted (continuously varied) as a function of the measured wind pressure.

In closing it should also be noted that instead of air, another gaseous medium can also naturally be discharge from the blower nozzles 11. The medium discharged is a function of the requirement for the lock. Another appropriate mixture can be used in the air lock for a clean room, for example.

FIG. 5 shows a control system with sensor apparatus for the operation of a door system according to at least one possible embodiment of the present invention. The door system as shown in FIG. 1 further comprises door sensors 106. The door sensors 106 detect and/or control the opening and closing of the doors upon sensing, for example, the location of the door, persons or objects entering or exiting the door system. Temperature sensors 102 and a wind sensor 104 are also provided as part of the system. The temperature sensors 102 and wind sensor 104 measure temperature and wind conditions on the exterior and interior of the door enclosure. The temperature sensors 102, wind sensor 104, and door sensors 106 supply information to a control system 116, such as a computer or microprocessor device. The control system 116 has an input databus 118 and an output databus 120. The input databus 118 receives and processes the information sent by the temperature sensors 102, wind sensor 104, and door sensors 106.

After the information is received, it is processed according to a computer program stored in the control system 116. Signals and data are then sent out by the output databus 120 to climate control units 110 and motors 108. The motors 108 permit the positional adjustment or steering of air jets 112 or fan, blower, or vent devices 112 to change the direction in which air is directed into the vestibule. The climate control units 110 each comprise fan devices 112 and an air conditioning and heating and cooling arrangement 114, which arrangement provides heated or cooled air to be blown by the air jets or fan device 112 into the space or vestibule 5.

Depending on the data received from the temperature sensors 102, wind sensor 104, and door sensors 106, the climate control units 110 and the motors 108 are operated according to an operating program. The direction of the vent devices 112 can be changed, thus changing the direction of flow of air into the vestibule. The temperature of the air can be changed by either heating or cooling the air by activating the heating and cooling arrangement 114 according to the output data.

During operation, for example, the temperature sensor 102 can detect a substantially cold or hot external temperature and send the information to the control system 116. The door sensor 106 may then detect persons attempting to enter the vestibule. The wind sensor 104 may also detect a substantially high wind velocity and direction of the wind blowing toward and/or past the vestibule. The control system 116 then processes this information. As the doors open, a signal is sent from the control system 116 to the climate control units 110 and the motors 108. The fan devices 112 may then be adjusted by the motors 108 to change the direction of air flow to create a curtain of air or wall of air at the open end of the vestibule. This curtain of air could simultaneously be heated or cooled and have its volume and velocity changed as needed by the heating/cooling unit 116 to essentially prevent the cold or hot air or draft blowing in from the outside of the vestibule, from outside or inside the building in which the vestibule is located, from entering the vestibule. The above is just one example of the various adjustments and control of air flow and temperature that are possible according to at least one embodiment of the present invention.

Some examples of movable partition or wall systems and devices for their operation that possibly may be utilized or incorporated in at least one possible embodiment of the present invention may be found in the following U.S. patents: U.S. Pat. No. 5,730,027, issued to inventor Hormann on Mar. 24, 1998; U.S. Pat. No. 5,461,829, issued to inventors Lehto et al. on Oct. 31, 1995; U.S. Pat. No. 5,404,675, issued to inventor Schmidhauser on Apr. 11, 1995; U.S. Pat. No. 5,329,857, issued to inventor Owens on Jul. 19, 1994; U.S. Pat. No. 5,295,281, issued to inventor Kordes on Mar. 22, 1994; U.S. Pat. No. 5,394,648, issued to inventor Kordes on Mar. 7, 1995; U.S. Pat. No. 5,417,013, issued to inventor Tillmann on May 23, 1995; U.S. Pat. No. 5,544,462, issued to inventor Kordes on Aug. 13, 1996; U.S. Pat. No. 5,406,761, issued to inventors Hobbiebrunken et al. on Apr. 18, 1995; U.S. Pat. No. 5,152,332, issued to inventor Siener on Oct. 6, 1992; U.S. Pat. No. 5,042,555, issued to inventor Owens on Aug. 27, 1991; U.S. Pat. No. 4,934,119, issued to inventor Ybarra on Jun. 19, 1990; U.S. Pat. No. 4,914,878, issued to inventors Tamaki et al. on Apr. 10, 1990; U.S. Pat. No. 4,895,246, issued to inventor Rizzi on Jan. 23, 1990; U.S. Pat. No. 4,752,987, issued to inventors Dreyer et al. on Jun. 28, 1988; U.S. Pat. No. 4,596,094, issued to inventors Teller et al. on Jun. 24, 1986; U.S. Pat. No. 4,555,828, issued to inventor Matimura on Dec. 3, 1985; U.S. Pat. No. 4,458,462, issued to inventor Schold on Jul. 10, 1984; U.S. Pat. No. 4,404,770, issued to inventor Markus on Sep. 20, 1983; and U.S. Pat. No. 4,112,647, issued to inventor Scheid on Sep. 12, 1978.

Some examples of drives or electromechanical or electrohydraulic drives that possibly may be utilized or incorporated in at least one possible embodiment of the present invention may be found in the following U.S. patents: U.S. Pat. No. 5,666,268, issued to inventors Rix et al. on Sep. 9, 1997; U.S. Pat. No. 5,386,885, issued to inventors Bunzl et al. on Feb. 7, 1995; U.S. Pat. No. 5,521,400, issued to inventor Schultze on Oct. 12, 1993; U.S. Pat. No. 5,080,635, issued to inventors Martinez et al. on Jan. 14, 1992; U.S. Pat. No. 4,501,090, issued to inventors Yoshida et al. on Feb. 26, 1985; and U.S. Pat. No. 4,430,846, issued to inventors Presley et al. on Feb. 14, 1984.

Some examples of electronic control or electronic regulation systems that possibly may be utilized or incorporated in at least one possible embodiment of the present invention may be found in the following U.S. patents: U.S. Pat. No. 5,770,934, issued to inventor Theile on Jun. 23, 1998; U.S. Pat. No. 5,666,268, issued to inventors Rix et al. on Sep. 9, 1997; U.S. Pat. No. 5,625,266, issued to inventor Stark on Apr. 29, 1997; U.S. Pat. No. 5,428,278, issued to inventors Bollengier et al. on Jun. 27, 1995; and U.S. Pat. No. 4,838,052, issued to inventors Williams et al. on Jun. 13, 1989.

Some examples of control systems that measure operating parameters and learn therefrom that possibly may be utilized or incorporated in at least one possible embodiment of the present invention may be found in the following U.S. patents: U.S. Pat. No. 5,770,934, issued to inventor Theile on Jun. 23, 1998; U.S. Pat. No. 5,191,272, issued to inventors Torii et al. on Mar. 2, 1993; U.S. Pat. No. 5,223,820, issued to inventors Sutterlin et al. on Jun. 29, 1993; and U.S. Pat. No. 4,655,188, issued to inventors Tomisawa et al. on Apr. 7, 1987.

Some examples of memories that possibly may be utilized or incorporated in at least one possible embodiment of the present invention may be found in the following U.S. patents: U.S. Pat. No. 5,789,887, issued to inventor Elischewski on Aug. 4, 1998; U.S. Pat. No. 5,770,934, issued to inventor Theile on Jun. 23, 1998; U.S. Pat. No. 5,453,736, issued to inventor Noren on Sep. 26, 1995; U.S. Pat. No. 5,315,220, issued to inventors Takimoto et al. on May 24, 1994; U.S. Pat. No. 4,994,724, issued to inventor Hsu on Feb. 19, 1991; U.S. Pat. No. 4,498,033, issued to inventors Aihara et al. on Feb. 5, 1985; and U.S. Pat. No. 4,328,540, issued to inventors Matsuoka et al. on May 4, 1982.

Some examples of microprocessors that possibly may be utilized or incorporated in at least one possible embodiment of the present invention may be found in the following U.S. patents: U.S. Pat. No. 5,770,934, issued to inventor Theile on Jun. 23, 1998; U.S. Pat. No. 5,653,056, issued to inventor Stark on Aug. 5, 1997; U.S. Pat. No. 5,647,173, issued to inventors Stark et al. on Jul. 15, 1997; U.S. Pat. No. 5,625,266, issued to inventor Stark on Apr. 29, 1997; U.S. Pat. No. 5,479,151, issued to inventors Lavelle et al. on Dec. 26, 1995; U.S. Pat. No. 5,453,736, issued to inventor Noren on Sep. 26, 1995; U.S. Pat. No. 5,437,174, issued to inventor Aydin on Aug. 1, 1995; U.S. Pat. No. 5,274,312, issued to inventor Gerstenkorn on Dec. 28, 1993; U.S. Pat. No. 5,230,179, issued to inventors Richmond et al. on Jul. 27, 1993; U.S. Pat. No. 5,142,152, issued to inventor Boiucaner on Aug. 25, 1992; U.S. Pat. No. 5,140,173, issued to inventors Chau et al. on Aug. 18, 1992; U.S. Pat. No. 5,136,809, issued to inventors Richmond et al. on Aug. 11, 1992; U.S. Pat. No. 5,132,503, issued to inventor Lee on Jul. 21, 1992; U.S. Pat. No. 4,980,618, issued to inventors Milnes et al. on Dec. 25, 1990; U.S. Pat. No. 4,831,509, issued to inventors Jones et al. on May 16, 1989; U.S. Pat. No. 4,815,046, issued to inventor Dorr on Mar. 21, 1989; and U.S. Pat. No. 4,779,240, issued to inventor Dorr on Oct. 18, 1988.

Some examples of open-loop control systems that possibly may be utilized or incorporated in at least one possible embodiment of the present invention may be found in the following U.S. patents: U.S. Pat. No. 5,770,934, issued to inventor Theile on Jun. 23, 1998; U.S. Pat. No. 5,210,473, issued to inventor Backstrand on May 11, 1993; U.S. Pat. No. 5,320,186, issued to inventors Strosser et al. on Jun. 14, 1994; and U.S. Pat. No. 5,369,342, issued to inventors Rudzewicz et al. on Nov. 29, 1994.

Some examples of closed-loop control circuits that possibly may be utilized or incorporated in at least one possible embodiment of the present invention may be found in the following U.S. patents: U.S. Pat. No. 5,770,934, issued to inventor Theile on Jun. 23, 1998; U.S. Pat. No. 5,189,605, issued to inventors Zuehlke et al. on Feb. 23, 1993; U.S. Pat. No. 5,223,072, issued to inventors Brockman et al. on Jun. 29, 1993; and U.S. Pat. No. 5,252,901, issued to inventors Ozawa et al. on Oct. 12, 1993.

Some examples of look up tables accessed by computers or microprocessors that possibly may be utilized or incorporated in at least one possible embodiment of the present invention may be found in the following U.S. patents: U.S. Pat. No. 5,284,116, issued to inventor Richeson, Jr. on Feb. 8, 1994; U.S. Pat. No. 5,359,325, issued to inventors Ford et al. on Oct. 25, 1994; : and U.S. Pat. No. 5,371,537, issued to inventors Bohan et al. on Dec. 6, 1994.

Some examples of guides, rollers, guide elements, or guide arrangements that possibly may be used in at least one possible embodiment of the present invention may be found in the following U.S. patents: U.S. Pat. No. 5,634,297, issued to inventor Ito on Jun. 3, 1997; U.S. Pat. No. 5,461,829, issued to inventors Lehto et al. on Oct. 31, 1995; U.S. Pat. No. 5,349,783, issued to inventors Jasperson et al. on Sep. 27, 1994; U.S. Pat. No. 5,263,280, issued to inventor Dilcher on Nov. 23, 1993; U.S. Pat. No. 5,203,116, issued to inventor Chen on Apr. 20, 1993; U.S. Pat. No. 5,063,710, issued to inventor Schap on Nov. 12, 1991; U.S. Pat. No. 5,039,143, issued to inventor Ramsauer on Aug. 13, 1991; U.S. Pat. No. 5,031,271, issued to inventor Baus on Jul. 16, 1991; U.S. Pat. No. 4,991,257, issued to inventor Eutebach on Feb. 12, 1991; U.S. Pat. No. 4,938,273, issued to inventors Dubbelman et al. on Jul. 3, 1990; U.S. Pat. No. 4,912,807, issued to inventors Futch et al. on Apr. 3, 1990; U.S. Pat. No. 4,924,625,. issued to inventor Dilcher on May 15, 1990; U.S. Pat. No. 4,836,263, issued to inventor Ament on Jun. 6, 1989; U.S. Pat. No. 4,802,707, issued to inventor Schlapp on Feb. 7, 1989; U.S. Pat. No. 4,773,465, issued to inventor Hamacher on Sep. 27, 1988; U.S. Pat. No. 4,707,022, issued to inventors Roos et al. on Nov. 17, 1987; U.S. Pat. No. 4,702,514, issued to inventor Perry on Oct. 27, 1987; U.S. Pat. No. 4,680,828, issued to inventors Cook et al. on Jul. 21, 1987; U.S. Pat. No. 4,672,712, issued to inventor Stevenson on Jun. 16, 1987; U.S. Pat. No. 4,668,008, issued to inventor Stinson on May 26, 1987; U.S. Pat. No. 4,577,577, issued to inventor Eriksson on Mar. 25, 1986; U.S. Pat. No. 4,565,031, issued to inventor Sakamoto on Jan. 21, 1986; U.S. Pat. No. 4,503,637, issued to inventor Parente on Mar. 12, 1985; U.S. Pat. No. 4,455,709, issued to inventor Zanini on Jun. 26, 1984; U.S. Pat. No. 4,398,373, issued to inventor Mancuso on Aug. 16, 1983; U.S. Pat. No. 4,358,863, issued to inventor Jacobsen on Nov. 16, 1982; U.S. Pat. No. 4,281,435, issued to inventors Winter et al. on Aug. 4, 1981; U.S. Pat. No. 4,228,560, issued to inventor Baus on Oct. 21, 1980; U.S. Pat. No. 4,183,179, issued to inventors Gutridge et al. on Jan. 15, 1980; U.S. Pat. No. 4,176,497, issued to inventor Nagy on Dec. 4, 1979; U.S. Pat. No. 4,176,496, issued to inventors Rock et al. on Dec. 4, 1979; U.S. Pat. No. 4,064,593, issued to inventor Helmick on Dec. 27, 1977; and U.S. Pat. No. 4,063,388, issued to inventor Little on Dec. 20, 1977.

Some examples of door closers that possibly may be utilized or incorporated in at least one possible embodiment of the present invention may be found in the following U.S. patents: U.S. Pat. No. 5,832,561, issued to inventor Bienek on Nov. 10, 1998; U.S. Pat. No. 5,802,670, issued to inventor Bienek on Sep. 8, 1998; U.S. Pat. No. 5,770,934, issued to inventor Theile on Jun. 23, 1998; U.S. Pat. No. 5,651,216, issued to inventor Tillmann on Jul. 29, 1997; U.S. Pat. No. 5,428,278, issued to inventors Bollengier et al. on Jun. 27, 1995; U.S. Pat. No. 5,417,013, issued to inventor Tillmann on May 23, 1995; U.S. Pat. No. 5,251,400, issued to inventor Schultze on Oct. 12, 1993; U.S. Pat. No. 4,669,147, issued to inventor Suchanek on Jun. 2, 1987; U.S. Pat. No. 4,501,090, issued to inventors Yoshida et al. on Feb. 26, 1985; U.S. Pat. No. 4,419,787, issued to inventor Lieberman on Dec. 13, 1983; and U.S. Pat. No. 4,285,094, issued to inventor Levings, Jr. on Aug. 25, 1981. Some further examples of door closers that possibly may be utilized or incorporated in a possible embodiment of the present invention may be found in the advertising brochure, entitled "Das Programm", for the company DORMA GmbH+Co. KG, Postfach 4009, D-58247 Ennepetal, Federal Republic of Germany, which advertising brochure bears the following identifying information: WN 051307, December 1996, Programm, D, 10, STB, February 1997, Atelier G. Heinz, Velbert, which advertising brochure describes, for example, on page 25, the door closer or drive system named the "DORMA ED 200".

Some examples of sensors, sensor systems, pressure sensing apparatuses, and/or strain gauges that possibly may be utilized or incorporated in at least one possible embodiment of the present invention may be found in the following U.S. patents: U.S. Pat. No. 5,770,934, issued to inventor Theile on Jun. 23, 1998; U.S. Pat. No. 5,625,266, issued to inventor Stark on Apr. 29, 1997; U.S. Pat. No. 5,428,278, issued to inventors Bollengier et al. on Jun. 27, 1995; U.S. Pat. No. 5,303,593, issued to inventor Kremidas on Apr. 19, 1994; U.S. Pat. No. 5,287,757, issued to inventors Polaert et al. on Feb. 22, 1994; U.S. Pat. No. 5,251,400, issued to inventor Schultze on Oct. 12, 1993; U.S. Pat. No. 5,241,308, issued to inventor Young on Aug. 31, 1993; U.S. Pat. No. 5,199,519, issued to inventors Polaert et al. on Apr. 6, 1993; U.S. Pat. No. 5,191,798, issued to inventors Tabata et al. on Mar. 9, 1993; U.S. Pat. No. 5,186,060, issued to inventor Marlier on Feb. 16, 1993; U.S. Pat. No. 5,142,152, issued to inventor Boiucaner on Aug. 25, 1992; U.S. Pat. No. 4,815,046, issued to inventor Dorr on Mar. 21, 1989; U.S. Pat. No. 4,779,240, issued to inventor Dorr on Oct. 18, 1988; U.S. Pat. No. 4,501,090, issued to inventors Yoshida et al. on Feb. 26, 1985; and U.S. Pat. No. 4,430,846, issued to inventors Presley et al. on Feb. 14, 1984.

Some examples of databuses or databus systems that possibly may be utilized or incorporated in at least one possible embodiment of the present invention may be found in the following U.S. patents: U.S. Pat. No. 6,008,546, issued to inventor Sage on Dec. 28, 1999; U.S. Pat. No. 5,978,193, issued to inventor Kaaden on Nov. 2, 1999; U.S. Pat. No. 5,815,732, issued to inventors Cooper et al. on Sep. 29, 1998; U.S. Pat. No. 5,507,001, issued to inventor Nishizawa on Apr. 9, 1996; U.S. Pat. No. 5,402,423, issued to inventors Van Kersen et al. on Mar. 28, 1995; U.S. Pat. No. 4,725,838, issued to inventors Maschek et al. on Feb. 16, 1998; U.S. Pat. No. 4,720,155, issued to inventors Schildkraut et al. on Jan. 19, 1988; and U.S. Pat. No. 4,488,066, issued to inventor Shoji on Dec. 11, 1984.

Some examples of devices or transmissions that possibly may be utilized or incorporated in at least one possible embodiment of the present invention may be found in the following U.S. patents: U.S. Pat. No. 4,763,385, issued to inventors Furch et al. on Aug. 16, 1988, and U.S. Pat. No. 4,744,125, issued to inventors Scheck et al. on May 17, 1988.

Some examples of fan or blower devices for heating, ventilation, and air-conditioning systems, which could possibly be used or adapted for use in at least on embodiment of the present invention may be found in the following U.S. patents: U.S. Pat. No. 6,070,660, entitled "Variable speed fan motor control for forced air heating/cooling system"; U.S. Pat. No. 6070,651, entitled "Thermal heating and cooling fan device"; U.S. Pat. No. 6,064,571, entitled "Fan duct module"; U.S. Pat. No. 6,023,939, entitled "Fan and motor assembly for an air-conditioner"; U.S. Pat. No. 6,022,200, entitled "Vertical arrangement of a dual heat exchanger/fan assembly"; U.S. Pat. No. 5,984,649, entitled "Air curtain fan with heating elements"; U.S. Pat. No. 5,818,194, issued on Oct. 6, 1998 to inventor Nordby; U.S. Pat. No. 5,911,563, issued on Jun. 15, 1999, to inventors Duppert, et al.; and U.S. Pat. No. 5,492,273, issued on Feb. 20, 1996 to inventor Shah.

Some examples of devices and systems for producing an air curtain for heating, ventilation, and air-conditioning systems, which could possibly be used or adapted for use in at least on embodiment of the present invention may be found in the following U.S. patents: U.S. Pat. No. 5,609,305, issued on Mar. 11, 1997 to inventor Webb; U.S. Pat. No. 5,984,649, issued on Nov. 16, 1999 to inventors Kato, et al.; U.S. Pat. No. 5,848,774, issued on Dec. 15, 1998 to inventor Bogage; U.S. Pat. No. 5,689,241, issued on Aug. 4, 1998 to inventor Lim; U.S. Pat. No. 5,765,635, issued on Jun. 16, 1998 to inventor Rhee; U.S. Pat. No. 5,113,749, issued on May 19, 1992 to inventor Perbix; U.S. Pat. No. 4,989,501, issued on Feb. 5, 1991 to inventor Catan; U.S. Pat. No. 4,979,432, issued on Dec. 25, 1990 to inventor Catan; U.S. Pat. No. 4,606,259, issued on Aug. 19, 1986 to inventor Nystrom; and U.S. Pat. No. 4,051,893, issued on Oct. 4, 1977 to inventor Guibert.

Some examples of temperature sensing devices for heating, ventilation, and air-conditioning systems, which could possibly be used or adapted for use in at least embodiment of the present invention may be found in the following U.S. patents: U.S. Pat. No. 6,081,182, issued on Jun. 27, 2000 to inventors Tomozawa, et al.; U.S. Pat. No. 6,079,875, issued on Jun. 27, 2000 to inventors Klass, et al.; U.S. Pat. No. 6,078,208, issued on Jun. 20, 2000 to inventors Nolan, et al.; U.S. Pat. No. 6,019,508, issued on Feb. 1, 2000 to inventor Lien; U.S. Pat. No. 6,014,890, issued on Jan. 18, 2000 to inventor Breen; U.S. Pat. No. 5,961,215, issued on Oct. 5, 1999 to inventors Lee, et al.; U.S. Pat. No. 5,959,524, issued on Sep. 28, 1999 to inventors Wienand, et al.; U.S. Pat. No. 5,934,554, issued on Aug. 10, 1999 to inventors Charles, et al.; U.S. Pat. No. 5,876,122, issued on Mar. 2, 1999 to inventor Eryurek; and U.S. Pat. No. 5,829,879, issued on Nov. 3, 1998 to inventors Sanchez, et al.

Some examples of wind sensing devices for heating, ventilation, and air-conditioning systems, which could possibly be used or adapted for use in at least embodiment of the present invention may be found in the following U.S. patents: U.S. Pat. No. 5,123,730, issued on Jun. 23, 1992 to inventors Holmes et al.; U.S. Pat. No. 5,102,230, issued on Apr. 7, 1992 to inventors Kobayashi et al.; U.S. Pat. No. 5,044,768, issued on Sep. 3, 1991 to inventors Kobayashi et al.; U.S. Pat. No. 5,010,771, issued on Apr. 30, 1991 to inventor Bruce; U.S. Pat. No. 4,625,565, issued on Dec. 2, 1986 to inventors Wada et al.; U.S. Pat. No. 4,615,214, issued on Oct. 7, 1986 to inventor Burns; U.S. Pat. No. 4,206,639, issued on Jun. 10, 1980 to inventor Balser; and U.S. Pat. No. 3,956,932, issued on May 18, 1976 to inventors Fletcher et al.

Some examples of steerable jets which could be used or adapted for use in at least one embodiment of the present invention may be found in the following U.S. patents: U.S. Pat. Nos. 5,944,686; 5,378,179; and 3,986,683.

Some examples of heating, ventilation and air conditioning (HVAC) systems and components therefor which could be used or adapted for use in at least one embodiment of the present invention may be found in the following U.S. patents: U.S. Pat. No. 6,082,128, issued on Jul. 4, 2000 to inventors take et al.; U.S. Pat. No. 6,079,627, issued on Jun. 27, 2000 to inventor Kettler; U.S. Pat. No. 6,064,310, issued on May 16, 2000 to inventors Busak, et al.; U.S. Pat. No. 6,059,027, issued on May 9, 2000 to inventors Lake et al.; U.S. Pat. No. 6,021,252, issued on Feb. 1, 2000 to inventors Faris et al.; U.S. Pat. No. 5,994,984, issued on Nov. 30, 1999 to inventors Stancil et al.; U.S. Pat. No. 5,988,517, issued on Nov. 23, 1999 to inventors Bauer et al.; U.S. Pat. No. 5,944,098, issued on Aug. 31, 1999 to inventor Jackson; U.S. Pat. No. 5,937,940, issued on Aug. 17, 1999 to inventors Davis, Jr. et al.; U.S. Pat. No. 5,937,891, issued on Aug. 17, 1999 to inventor Scoccia; U.S. Pat. No. 5,911,747, issued on Jun. 15, 1999 to inventor Gauthier; U.S. Pat. No. 5,909,378, issued on Jun. 1, 1999 to inventor De Milleville; U.S. Pat. No. 5,845,509, issued on Dec. 8, 1998 to inventors Shaw et al.; U.S. Pat. No. 5,816,059, issued on Oct. 6, 1998 to inventors Ficchi, Jr. et al.; U.S. Pat. No. 5,801,940, issued on Sep. 1, 1998 to inventors Russ et al.; U.S. Pat. No. 5,787,027, issued on Jul. 28, 1998 to inventors Dolan et al.; U.S. Pat. No. 5,773,730, issued on Jun. 30, 1998 to inventors McConnell et al.; U.S. Pat. No. 5,769,314, issued on Jun. 23, 1998 to inventors Drees et al.; U.S. Pat. No. 5,751,948, issued on May 12, 1998 to inventors Dolan et al.; U.S. Pat. No. 5,729,474, issued on Mar. 17, 1998 to inventors Hildebrand et al.; U.S. Pat. No. 5,711,480, issued on Jan. 27, 1998 to inventors Zepke et al.; U.S. Pat. No. 5,706,190, issued on Jan. 6, 1998 to inventors Russ et al.; U.S. Pat. No. 5,705,734, issued on Jan. 6, 1998 to inventor Ahmed; U.S. Pat. No. 5,663,535, issued on Sep. 2, 1997 to inventors MacDonald et al.; U.S. Pat. No. 5,544,809, issued on Aug. 13, 1996 to inventors Keating et al.; U.S. Pat. No. 5,506,768, issued on Apr. 9, 1996 to inventors Seem et al.; U.S. Pat. No. 5,491,649, issued on Feb. 13, 1996 to inventors Friday, Jr. et al.; and U.S. Pat. No. 5,427,313, issued on Jun. 27, 1995 to inventors Davis, Jr. et al.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The following Federal Republic of Germany patents, patent applications, patent publications, or references, which were cited in a foreign Office Action, and/or cited elsewhere, are hereby incorporated by reference as if set forth in their entirety herein as follows: No. DE 38 06 234 C2; No. DE 195 42 714; No. DE-AS 12 91 091; No. DE-AS 10 30 550; No. DE-Z HLH Bd. 48 (1997), Nr. 7—Juli, S. 43; and DE-Z TAB October 1988, Seiten 753 bis 756.

The corresponding foreign patent publication applications, namely, Federal Republic of Germany Patent Application No. 199 32 153.1, filed on Jul. 12, 1999, having inventor Christian Hein, and DE-OS 199 32 153.1 and DE-PS 199 32 153.1, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses, if any, are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of of the invention.

NOMENCLATURE

1 Outside side-piece
2 Wall
3 Inside side-piece
4 Inside moving panel
5 Interior lock
6 Interior of building
7 Exterior of building
8 Outer moving panel
9 Vertical ventilation duct
10 Vertical ventilation duct
11 Blower nozzle
12 Direction of airflow
13 Horizontal ventilation duct
14 Wind pressure from outside
15 Direction of airflow

What is claimed is:

1. A sliding door:

with two outer side pieces extending from a building wall and surrounding a building entrance/exit;

with at least one outer moving panel associated with the two outer side-pieces which closes or opens an entrance/exit as a result of its movement into a closed or open position; and with a ventilation system which, by means of at least one blower nozzle that is located so that it can be pivoted to face toward either one of the interior and exterior of the building, blows air into the building entrance/exit area;

wherein the at least one blower nozzle is coupled with an air speed indicator so that a pivoting angle of the at least one blower nozzle can be adjusted as a function of the outside pressure on the outside of the building as measured by the air speed indicator, or the quantity of air discharged from the at least one blower nozzle is varied;

the sliding door is a curved sliding door, and the outer side-pieces and the outer moving panels are curved;

there are two inner side-pieces that run into the interior of the building and are adjacent to the outer side-pieces, whereby at least one inner moving panel is associated with the inner side-pieces; and the opening degree of at least one of the at least one outer moving panel and the at least one inner moving panel can be set as a function of the outside pressure measured by the air speed indicator.

2. The sliding door as claimed in claim 1, wherein the at least one outer moving panel is opened, and the at least one inner moving panel is simultaneously closed, and vice-versa.

3. The sliding door as claimed in claim 2, wherein the pivoting angle of the at least one blower nozzle can be set as a function of the opening degree of the at least one outer moving panel.

4. The sliding door as claimed in claim 2, wherein the pivoting angle of the at least one blower nozzle can be set as a function of the maximum opening width of the at least one outer moving panel.

5. The sliding door as claimed in claim 3, wherein the at least one blower nozzle is fixed.

6. The sliding door as claimed in claim 3, wherein the at least one blower nozzle located on both sides and on the ceiling of the building entrance/exit area.

7. The sliding door as claimed in claim 4, wherein the at least one blower nozzle is located in respective ventilation ducts.

8. The sliding door as claimed in claim 6, wherein another gaseous medium can be discharged instead of air.

* * * * *

UNITED STATES PATENT AND TRADEMARK OFFICE

CERTIFICATE OF CORRECTION

PATENT NO. : 6,375,562 B1
DATED : April 23, 2002
INVENTOR(S) : Christian Hein

It is certified that error appears in the above-identified patent and that said Letters Patent is hereby corrected as shown below:

Column 4,
Line 26, after "been", delete "stalled." and insert -- installed. --.
Line 33, after "be", delete "discharge" and insert -- discharged --.

Column 7,
Line 41, after "4,924,625", delete ",." and insert -- , --.

Column 10,
Line 14, after "inventors", delete "take" and insert -- Lake --.

Signed and Sealed this

Eighteenth Day of April, 2006

JON W. DUDAS
*Director of the United States Patent and Trademark Office*